US010352511B2

(12) United States Patent
Verfuerth et al.

(10) Patent No.: US 10,352,511 B2
(45) Date of Patent: Jul. 16, 2019

(54) LIGHTING FIXTURE

(71) Applicant: Energy Bank Incorporated, Manitowoc, WI (US)

(72) Inventors: Neal R. Verfuerth, Manitowoc, WI (US); Brandon James King, Manitowoc, WI (US)

(73) Assignee: Energy Bank Incorporated, Manitowoc, WI (US)

( * ) Notice: Subject to any disclaimer, the term of this patent is extended or adjusted under 35 U.S.C. 154(b) by 0 days.

(21) Appl. No.: 15/451,017

(22) Filed: Mar. 6, 2017

(65) Prior Publication Data

US 2017/0254486 A1 Sep. 7, 2017

Related U.S. Application Data

(63) Continuation-in-part of application No. 29/565,886, filed on May 25, 2016, now Pat. No. Des. 833,052.

(60) Provisional application No. 62/303,752, filed on Mar. 4, 2016.

(51) Int. Cl.

| | |
|---|---|
| ***F21S 8/02*** | (2006.01) |
| ***F21V 29/70*** | (2015.01) |
| ***F21V 23/00*** | (2015.01) |
| *F21Y 115/10* | (2016.01) |
| *F21V 15/015* | (2006.01) |

(52) U.S. Cl.

CPC ..... *F21S 8/026* (2013.01); *F21V 23/007* (2013.01); *F21V 29/70* (2015.01); *F21V 15/015* (2013.01); *F21Y 2115/10* (2016.08)

(58) Field of Classification Search

CPC .. F21S 8/026; F21S 8/04; F21V 29/70; F21V 23/007; F21V 15/015; F21V 15/00; F21V 15/01; F21V 21/02; F21V 21/025; F21V 23/008; F21Y 2115/10

See application file for complete search history.

(56) References Cited

U.S. PATENT DOCUMENTS

| | | | | |
|---|---|---|---|---|
| 6,585,396 | B1 | 7/2003 | Verfuerth | |
| 6,758,580 | B1 | 7/2004 | Verfuerth | |
| D494,700 | S | 8/2004 | Hartman et al. | |
| 6,964,502 | B1 | 11/2005 | Verfuerth | |
| 7,300,180 | B2 | 11/2007 | Hutchison et al. | |
| 7,401,942 | B1 | 7/2008 | Verfuerth et al. | |
| 7,563,006 | B1 | 7/2009 | Verfuerth et al. | |
| 7,575,338 | B1 | 8/2009 | Verfuerth | |
| 7,628,506 | B2 | 12/2009 | Verfuerth et al. | |
| 7,784,966 | B2 | 8/2010 | Verfuerth et al. | |
| 8,136,958 | B2 | 3/2012 | Verfuerth et al. | |
| 8,337,043 | B2 | 12/2012 | Verfuerth et al. | |
| 8,376,583 | B2 | 2/2013 | Wang et al. | |
| 2009/0213589 | A1* | 8/2009 | Peifer | F21S 8/00 362/147 |
| 2010/0157610 | A1* | 6/2010 | Xiao | F21V 15/013 362/370 |
| 2012/0020094 | A1* | 1/2012 | Chang | F21S 8/04 362/382 |
| 2013/0193857 | A1 | 8/2013 | Tlachac et al. | |

(Continued)

*Primary Examiner* — Bao Q Truong

(74) *Attorney, Agent, or Firm* — Smith Keane LLP

(57) ABSTRACT

A lighting fixture that can be installed in a ceiling or retrofitted into a ceiling containing ceiling tiles mounted in a grid, while providing a more pleasing aesthetic appearance than prior art lighting fixtures.

11 Claims, 27 Drawing Sheets

(56) References Cited

U.S. PATENT DOCUMENTS

| | | | | |
|---|---|---|---|---|
| 2014/0268801 | A1* | 9/2014 | Madden | F21S 8/026<br>362/294 |
| 2015/0003070 | A1* | 1/2015 | Medendorp, Jr. | F21K 9/17<br>362/294 |
| 2016/0123564 | A1* | 5/2016 | Quilici | F21V 23/003<br>362/233 |

* cited by examiner

LIGHTING FIXTURE

RELATED APPLICATIONS

This application claims the benefit of U.S. Provisional Patent Application No. 62/303,752, filed on 4 Mar. 2016, entitled "Lighting Fixture," and U.S. Design patent application Ser. No. 29/565,886 filed on 25 May 2016, entitled "Lighting Fixture," both of which are incorporated herein by reference in their entireties.

BACKGROUND OF THE INVENTION

As shown in FIGS. 1 and 2, conventional ceiling arrays 100 include a grid formed of a plurality of support members 102 that form a grid which form a plurality of openings 104. Conventionally, the openings 104 have a width of about 2 feet and a length of about 2 feet (as shown in FIGS. 1 and 2) or about 4 feet. Conventional lighting fixtures 106 mount within certain ones of the openings 104 and completely fill the opening 104. In the openings 104 without a lighting fixture 106, the opening 104 is completely filled by a tile 108, such as an acoustical tile. As a result of this structure, the lighting fixtures 106 are very prominent in a room, and do not provide a pleasing aesthetic appearance.

Due to these factors, the installation, servicing, utilization, and monitoring of multiple systems is cost prohibitive, or at the very least cumbersome and inefficient, to use in many LTC facilities and could drive some LCT facilities to install a system that does not meet all of its actual needs.

SUMMARY OF THE INVENTION

The present disclosure relates to a lighting fixture that can be installed in a ceiling or retrofitted into a ceiling containing ceiling tiles mounted in a grid, while providing a more pleasing aesthetic appearance than prior art lighting fixtures.

One object of the present invention is to provide light fixture with a heat sink having a heat sink length, a base wall extending along the heat sink length having a first side edge, a second side edge opposite the first side edge, a first end, a second end opposite the first end, an inside surface, and an outside surface, a first depending side wall extending from the first side edge of the base wall along the heat sink length, and a second depending side wall extending from the second side edge of the base wall along the heat sink length; each of the first and second depending sidewalls having a lower end portion extending inward toward each other along the heat sink length; a driver housing assembly affixed to the outside surface of the heat sink, the driver housing assembly comprising a driver, a housing, and a cover, wherein the driver is housed within a cavity defined by the housing and the cover; at least one light emitting diode (LED) affixed to the inside surface of the heat sink and in electrical communication with the driver; a substantially planar lens received within the heat sink along the lower end portions of the first and second depending side walls and extending over the at least one LED; a first end cap attached to the heat sink at the first end; and a second end cap attached to the heat sink at the second end.

The light fixture may also have a potentiometer in electrical communication with the driver and the at least one LED.

The first and second depending side walls of the light fixture may angle outwardly from the base wall away from each other, whereby the slopes of the first and second side walls are additive inverses of each other. Also, the first end cap may have a shelf portion that extends inwardly into the heat sink and between the lower end portions of the first and second depending side walls and the second end cap may have a shelf portion that extends inwardly into the heat sink and between the lower end portions of the first and second depending side walls.

The light fixture may also include at least one panel affixed to and extending from at least one of the first and second depending side walls. Further, the light fixture may be configured to be installed within a two-foot by two-foot tray-ceiling opening or a two-foot by four-foot tray-ceiling opening. The light fixture may further include a first frame member affixed to the at least one panel at the first end of the heat sink and a second frame member affixed to the at least one panel at the second end of the heat sink, whereby the at least one panel angles downward from the heat sink at an angle greater than zero degrees relative to the lens. The first frame member may have a shelf portion with a slot, the shelf portion extending outwardly away from the heat sink and substantially coplanar with the lower end portions of the first and second depending side walls, and the second frame member may also have a shelf portion with a slot, the shelf portion extending outwardly away from the heat sink and substantially coplanar with the lower end portions of the first and second depending side walls. The first end cap may have an offset portion with a tab extending therefrom configured to be receivable within the slot of the shelf portion of the first frame member, and the second end cap may have an offset portion with a tab extending therefrom configured to be receivable within the slot of the shelf portion of the second frame member. The distance between the tabs of the first and second end caps defines a total shelf length, whereby the substantially planar lens has a length greater than the heat sink length and less than the total shelf length.

The first end cap may have a pair of feet configured to contact the shelf portion of the first frame member and define a first distance between the offset portion of the first end cap and the shelf portion of the first frame member, and the second end cap may also have a pair of feet configured to contact the shelf portion of the second frame member and define a second distance between the offset portion of the second end cap and the shelf portion of the second frame member, whereby the thickness of the lens is less than both the first distance and the second distance.

The length of the substantially planar lens may also be greater than or equal to $$\text{the heat sink length} + \frac{\text{total shelf length} - \text{heat sink length}}{2}$$

and less than the total shelf length when exposed to an ambient temperature of 27° C., and the lens is configured to experience a heat expansion of less than or equal to about 0.4% of the length of the lens when exposed to heat generated by the light fixture during use.

The first frame member may alternative have a shelf portion extending inwardly into the heat sink and substantially coplanar with the lower end portions of the first and second depending side walls, and the second frame member may have a shelf portion extending inwardly into the heat sink and substantially coplanar with the lower end portions of the first and second depending side walls, whereby the substantially planar lens may have a length greater than the total opening length and less than the heat sink length.

The length of the substantially planar lens may also be greater than or equal to $$\text{heat sink length } 324L - \frac{\text{heat sink length } 324L - \text{total opening length } 370}{2}$$

and less than the heat sink length when exposed to an ambient temperature of 27° C., and the lens is configured to experience a heat expansion of less than or equal to 0.4% the length of the lens when exposed to heat generated by the light fixture during use.

DESCRIPTION OF THE PREFERRED EMBODIMENT

Figure 1:
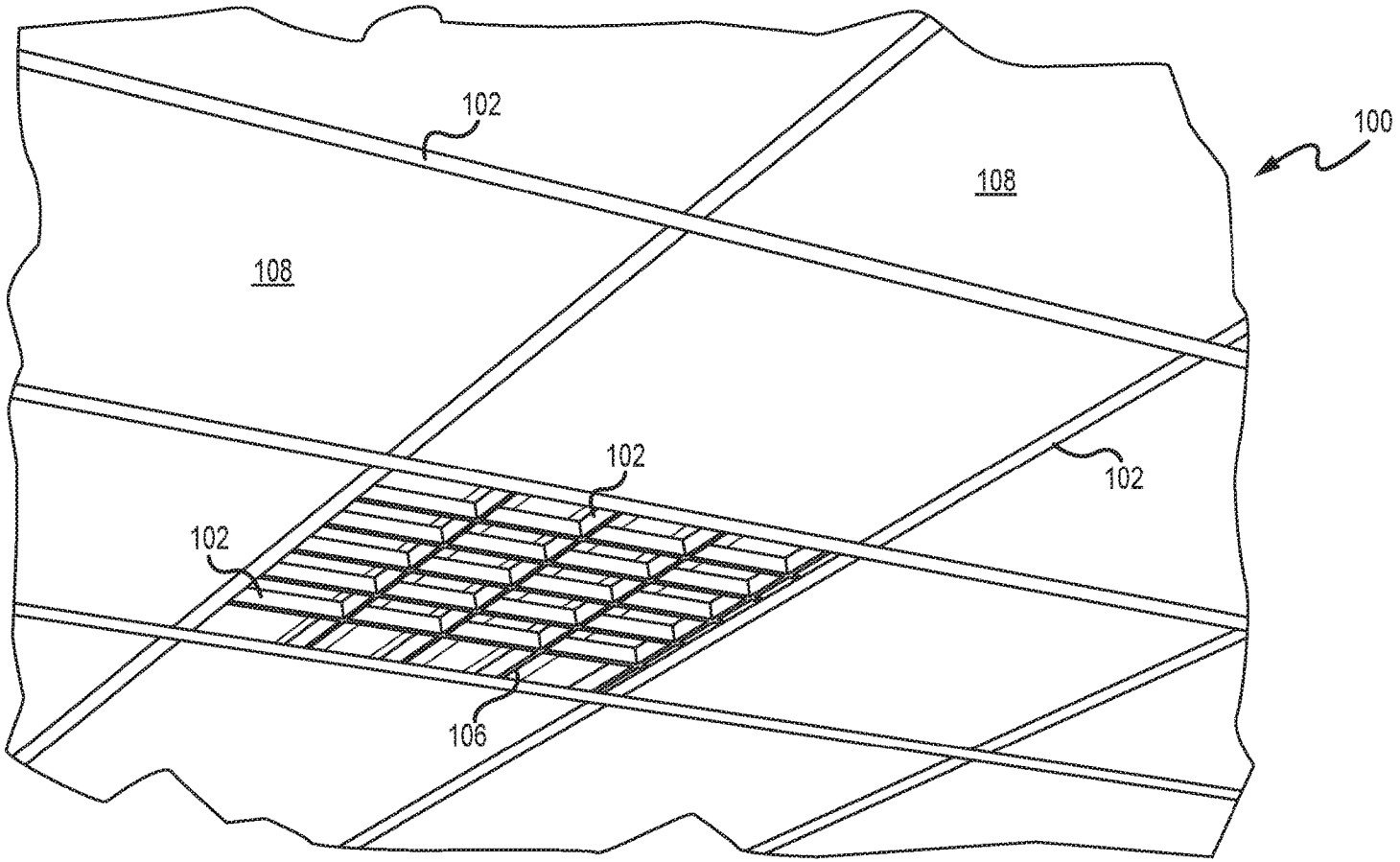
FIG. 1 (PRIOR ART)
FIG. 1 is a perspective view of a conventional ceiling array as is known in the art.

While the disclosure may be susceptible to embodiment in different forms, there is shown in the drawings, and herein will be described in detail, specific embodiments with the understanding that the present disclosure is to be considered an exemplification of the principles of the disclosure, and is not intended to limit the disclosure to that as illustrated and described herein. Therefore, unless otherwise noted, features disclosed herein may be combined to form additional combinations that were not otherwise shown for purposes of brevity. It will be further appreciated that in some embodiments, one or more elements illustrated by way of example in a drawing(s) may be eliminated and/or substituted with alternative embodiments within the scope of the disclosure.

Figure 3:
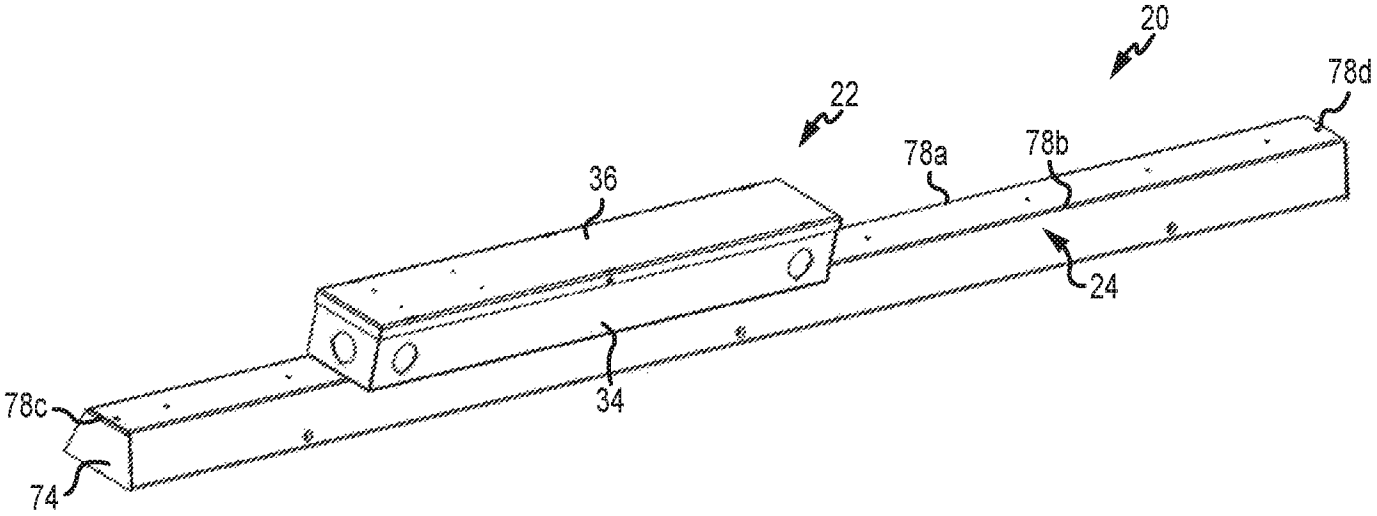
FIG. 3 is a perspective view of a first embodiment of a light fixture according to the present invention.
Figure 4:
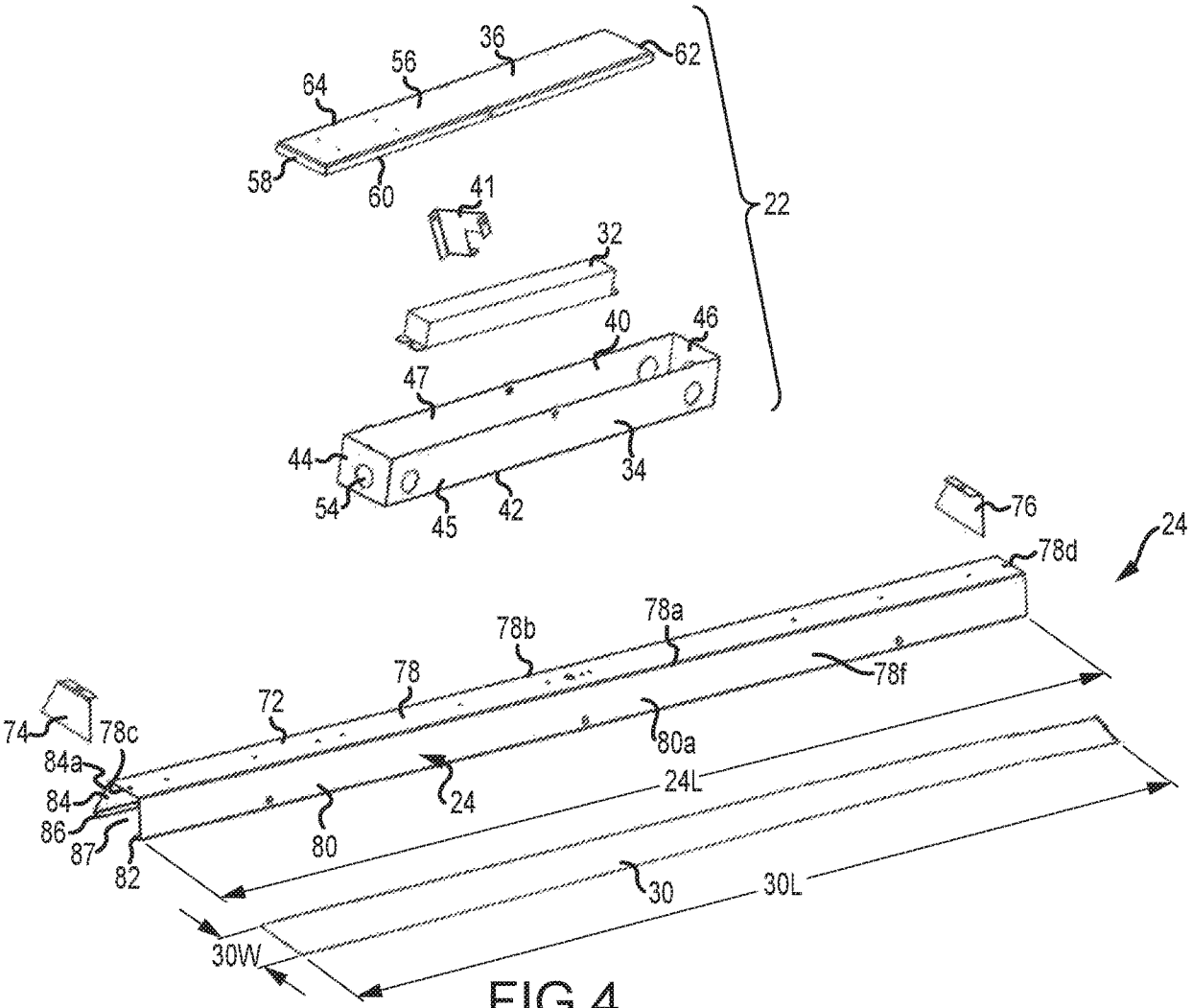
FIG. 4 is an exploded view of the light fixture shown in FIG. 3 according to the present invention.
Figure 5:
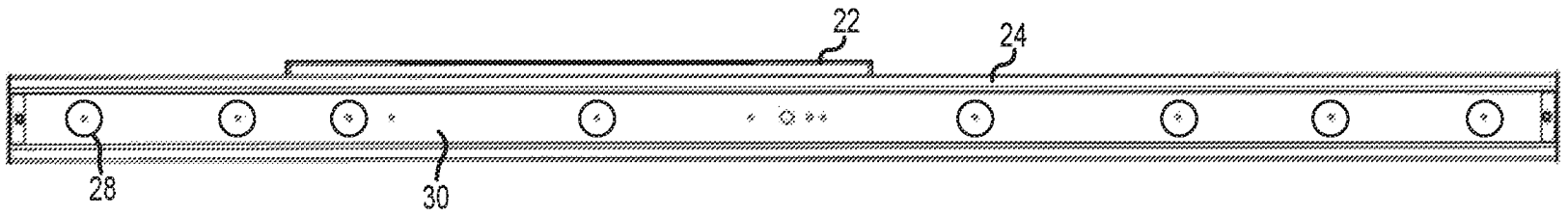
FIG. 5 is a bottom plan view of the light fixture shown in FIG. 3 according to the present invention.

As shown in FIGS. 3-5, a lighting fixture 20 is provided and is adapted to be mounted within an opening 104 of the conventional ceiling 100 described in the prior art. In an embodiment, the lighting fixture 20 is used in a commercial and industrial settings, such as a warehouse. The lighting fixture 20 provides well distributed and uniform light for open areas.

The lighting fixture 20 includes a driver housing assembly 22, a heat sink 24, at least one lighting source 28, and a lens 30. The heat sink 24 is preferably coupled to the driver housing assembly 22. The at least one lighting source 28 is preferably mounted to the heat sink 24.

The driver housing assembly 22 preferably includes housing 34, a cover 36, and a driver 32. The driver 32 is configured to control the illumination of the at least one lighting source 28. Such drivers 32 are known in the art. The at least one lighting source 28 is preferably a light emitting diode (LED).

The housing 34 is preferably formed from an elongated, horizontal base wall 42 having upstanding side walls 44, 45, 46, 47 extending from the edges of the base wall 42. The walls 42, 44, 45, 46, 47 define a cavity 40. In a preferred embodiment, the walls 44, 45, 46, 47 are vertical. One of the walls, such as wall 44 is illustrated with a knockout 54 provided therethrough. The knockout 54 is configured to be removed if necessary to provide a pathway for wires (not shown) to enter and exit the cavity 40, and to and from the driver 32.

The cover 36 preferably includes a base wall 56 having walls 58, 60, 62, 64 extending downwardly therefrom. The cover 36 is preferably configured to cover the cavity 40 such that the walls 58, 60, 62, 64 of the cover 36 engage, and may overlap, the walls 44, 45, 46, 47 of the housing 34. The cover 36 and the housing 34 are preferably joined together, such as by fasteners (not shown).

The driver 32 is mounted to the housing 34, preferably the base wall 42, within the cavity 40 and may be mounted in the housing 34 by a bracket 41. Other electronics and electrical components which may generate heat may be mounted to the housing 34 within the cavity 40.

Figure 6:
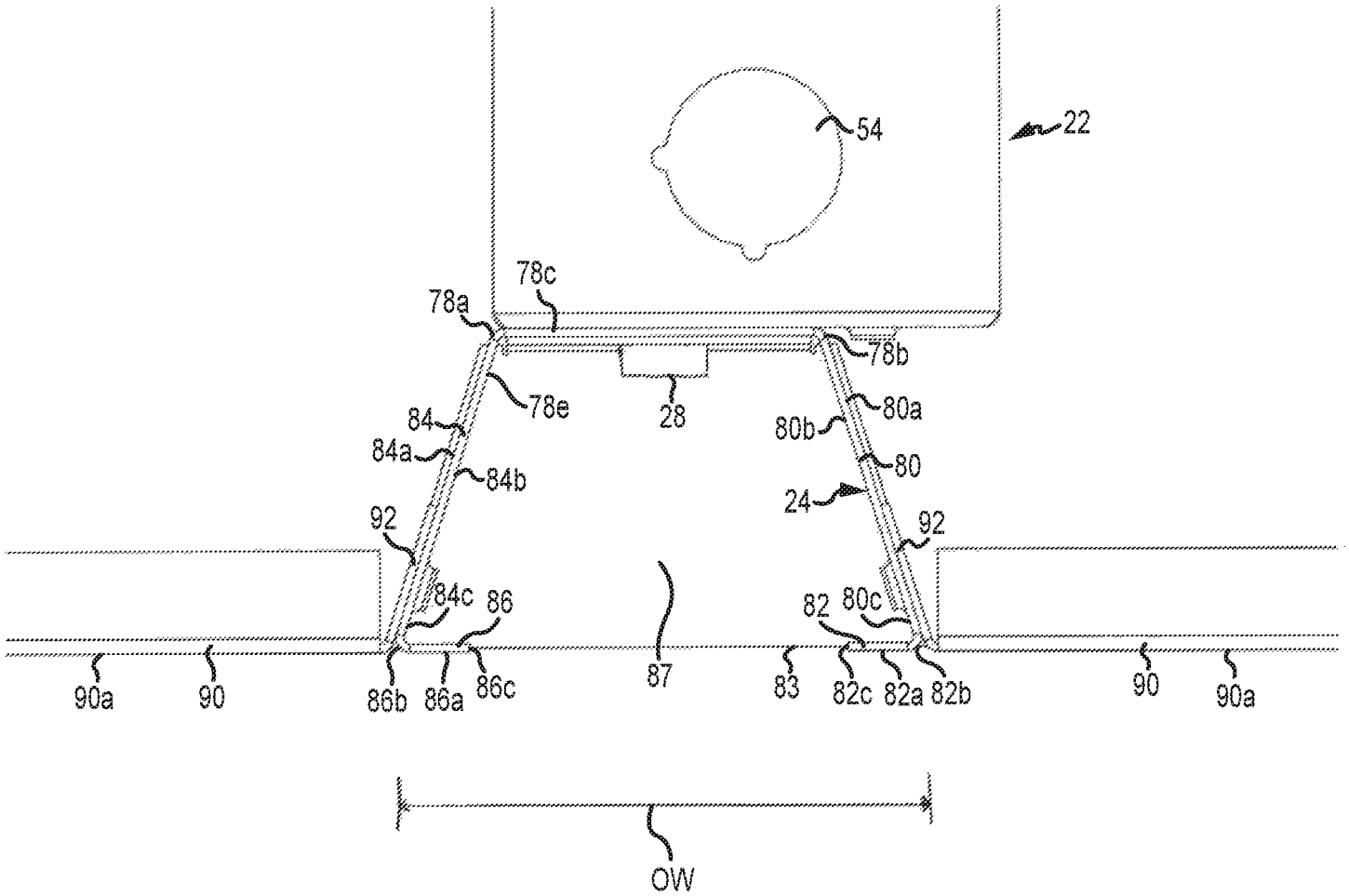
FIG. 6 is an end elevation view of the first embodiment light fixture with attached panels according to the present invention.
Figure 7:
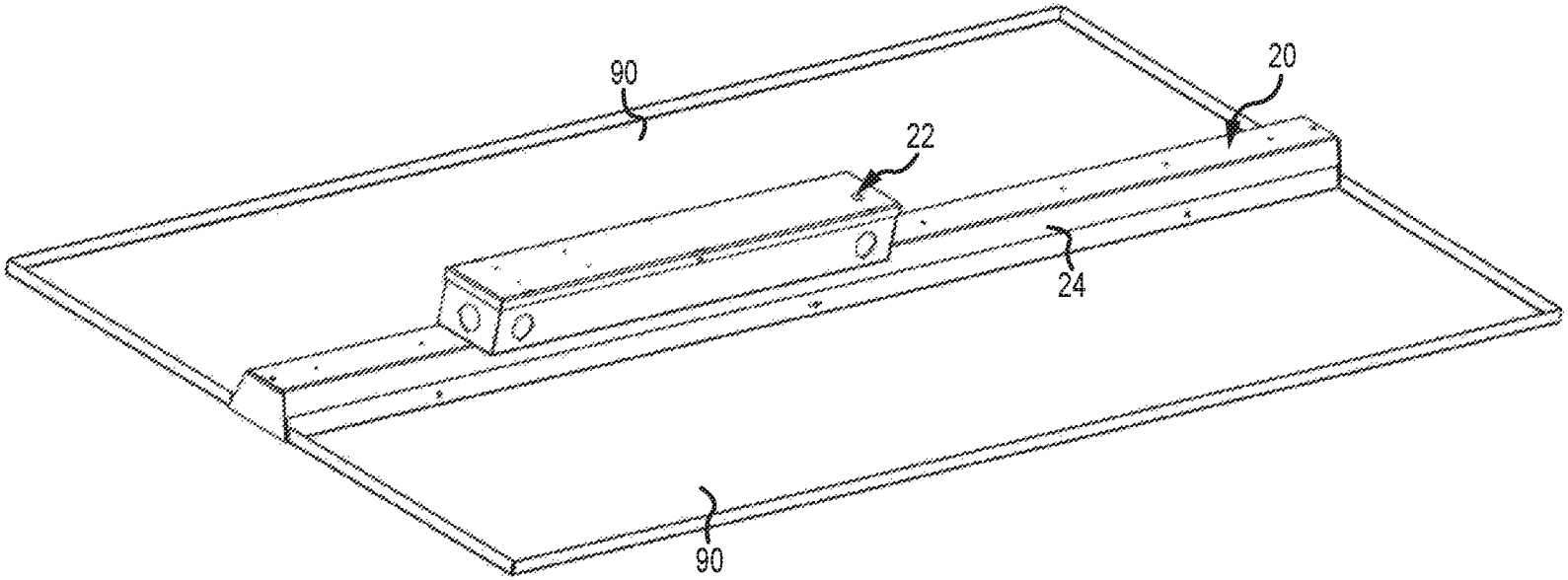
FIG. 7 is a perspective view of the light fixture shown in FIG. 6 according to the present invention.
Figure 8:
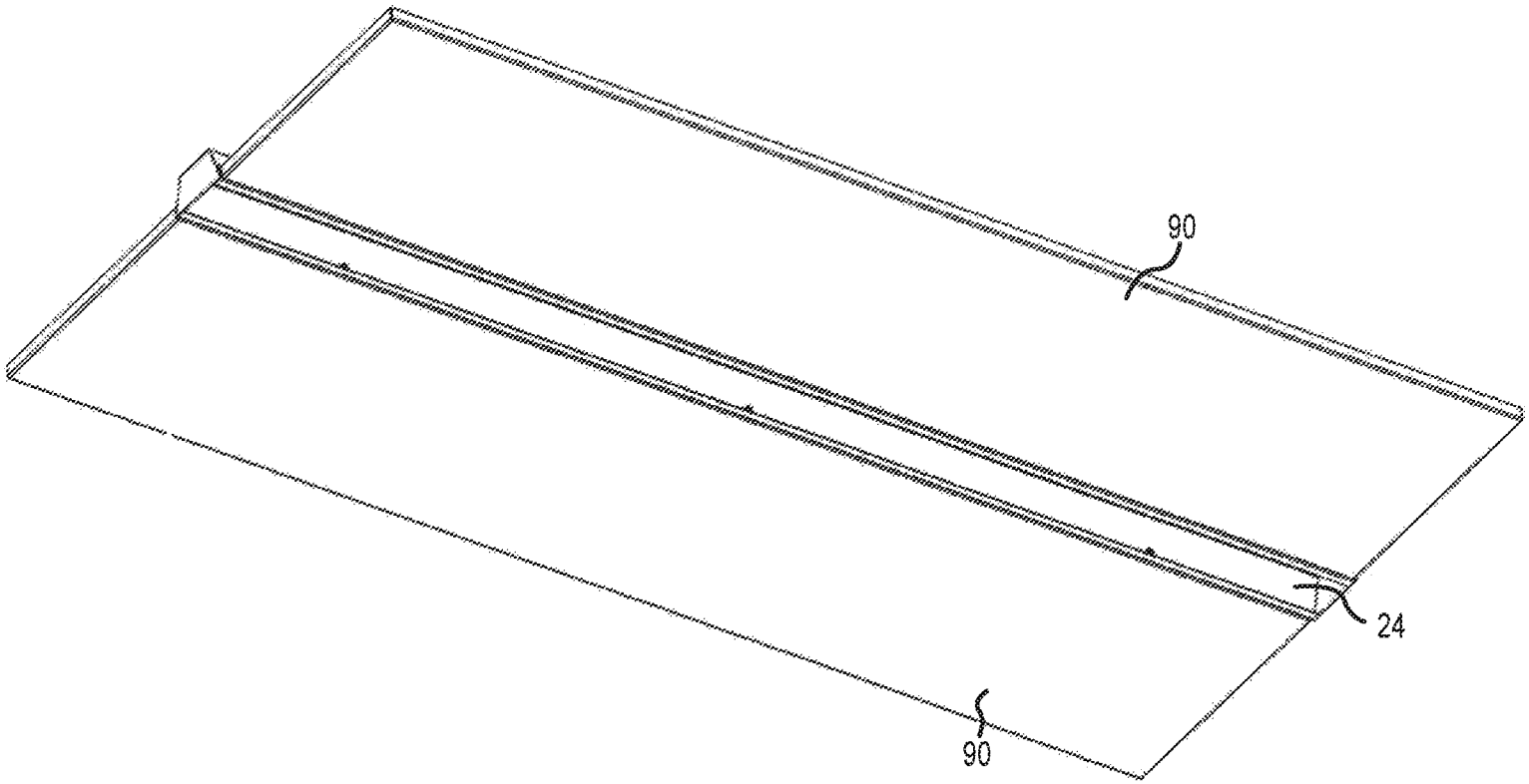
FIG. 8 is a perspective view of the light fixture shown in FIG. 6 according to the present invention.

Looking at FIGS. 4 and 6, the heat sink is described in further detail. The heat sink 24 is formed from an elongated, generally U-shaped channel 72 having a first end cap 74 and a second end cap 76 closing each end of the channel 72. The channel 72 is formed from a horizontal base wall 78 having opposite first and second side edges 78*a*, 78*b*, first and second ends 78*c*, 78*d* extending between the first and second side edges 78*a*, 78*b*, an inside surface 78*e*, and an outside surface 78*f*; a first depending side wall 80 extending from the first side edge 78*a* of the base wall 78; a first flange 82 extending inwardly from the lower end portion 80*c* of the side wall 80; a second depending side wall 84 depending from the second side edge 78*b* of the base wall 78; and a second flange 86 extending inwardly from the lower end portion 84*c* of the side wall 84. The walls 78, 80, 84 and flanges 82, 86 define a recess 87. The side walls 80, 84 have an outer surface 80*a*, 84*a* and an inner surface 80*b*, 84*a*, respectively.

Preferably, the side walls 80, 84 extend outwardly from the horizontal base wall 78 away from each other. The slopes of the side walls 80, 84 are preferably additive inverses of each other, and the flanges 82, 86 are substantially co-planar and substantially parallel to the base wall 78; however, it is contemplated that the flanges 82, 86 may angle inwardly in the direction of the base wall 78.

Each of the first and second flanges 82, 86 has an outer surface 82*a*, 86*a*; a proximal end portion 82*b*, 86*b*; a distal end 82*c*, 86*c*; and an inner surface 82*d*, 86*d*. The outer surface 82*a*, 86*a* defines a lowermost extent of the lighting fixture 20. The proximal end portions 82*b*, 86*b* adjoin the lower end portions 80*c*, 84*c* of the first and second side walls 80, 84, respectively.

The heat sink 24 has an outer width OW defined from the outer surface 80*a* at the lower end portion 80*c* of the first side wall 80 through the outer surface 84*a* at the lower end portion 84*c* of the second side wall 84 and an opening 83 defined by the space between the distal ends 82*c*, 86*c*.

The heat sink 24 may be formed of a cured synthetic polymerization composite which includes at least one polymerized resin and at least one additive which is disclosed in U.S. provisional application Ser. No. 14/854,906, filed on Sep. 15, 2015, the disclosure of which is incorporated by reference in its entirety. It is also contemplated that the heat sink 24 may be formed of a suitable metal, such as aluminum.

The base wall 42 of the driver housing assembly 22 is preferably secured to the outside surface 78*f* of the heat sink 24. The driver housing assembly 22 may be centered on the outside surface 78*f* or offset toward any of the first side edge 78*a*, the second side edge 78*b*, the first end 78*c*, and the second end 78*d*.

The lens 30 has a lens width 30W and a lens length 30L and is preferably comprised of a thermoplastic polymer (e.g., polycarbonate, acrylic, etc.). The lens width 30W is preferably greater than the shortest distance between the distal end 82*c*, 86*c* of the first and second flanges 82, 86 and the opposite first or second side wall 80, 84 to reduce the likelihood that the lens would tip up and out of the heat sink channel 72. The lens 30 preferably extends across the opening 83 and is supported by the first and second flanges 82, 86. The lens 30 is configured to cover the at least one lighting source 28.

The at least one lighting source 28 is mounted within the heat sink channel 72, preferably to the inside surface 78*e* of the horizontal base wall 78 of the heat sink 24. The heat sink 24 is preferably configured to dissipate heat generated by the at least one lighting source 28.

The outer width OW of the heat sink 24 is preferably substantially narrower than the width of the opening 104 in the ceiling 100. As shown, the outer width OW of the heat sink 24 is preferably from about two inches to about seven inches which is substantially less than the width of two feet of the opening 104. The heat sink 24 has a length 24L preferably substantially equal to the length of the opening 104, which can be about two feet or about four feet.

Figure 2:
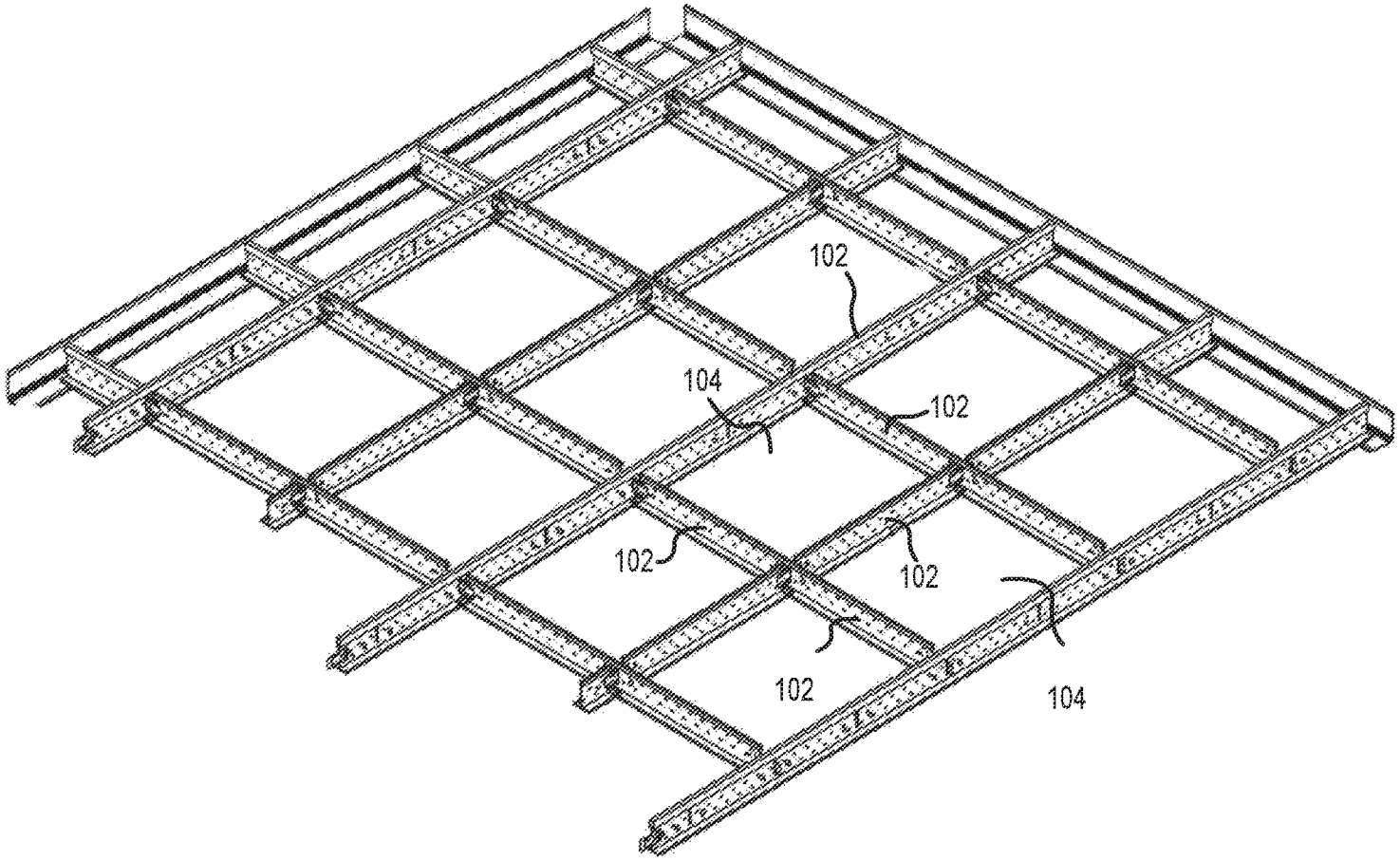
FIG. 2 (PRIOR ART)
FIG. 2 is a perspective view of a conventional ceiling array as is known in the art.

The lighting fixture 20 is configured to mount within a conventional grid-type ceiling 100 as shown in FIGS. 1 and 2. The lighting fixture 20 is preferably mounted within the opening 104 such that the first and second ends 78*c*, 78*d* of the heat sink 24 engage with the support members 102.

Figure 9:
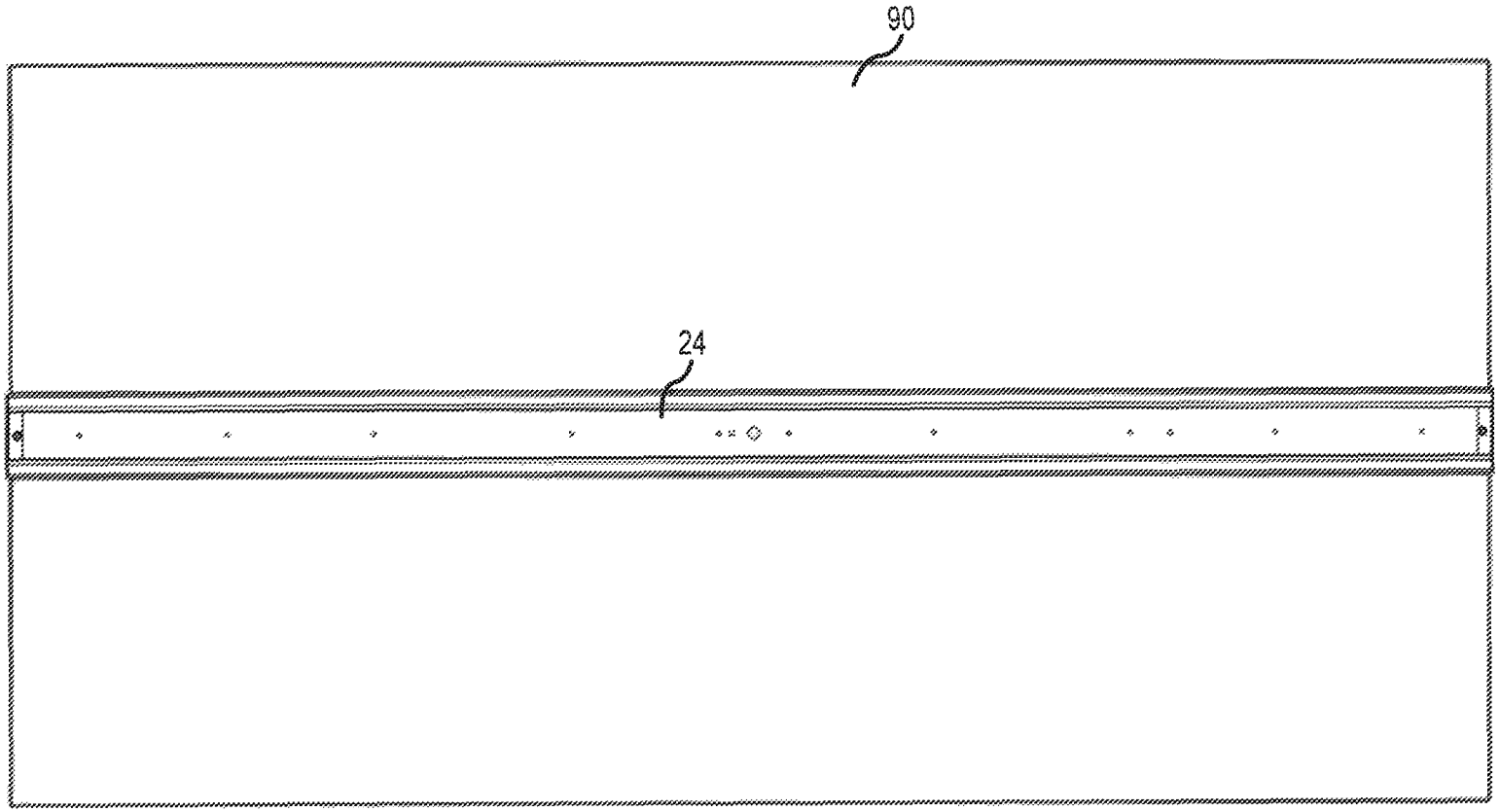
FIG. 9 is a top plan view of the light fixture shown in FIG. 6 according to the present invention.
Figure 10:
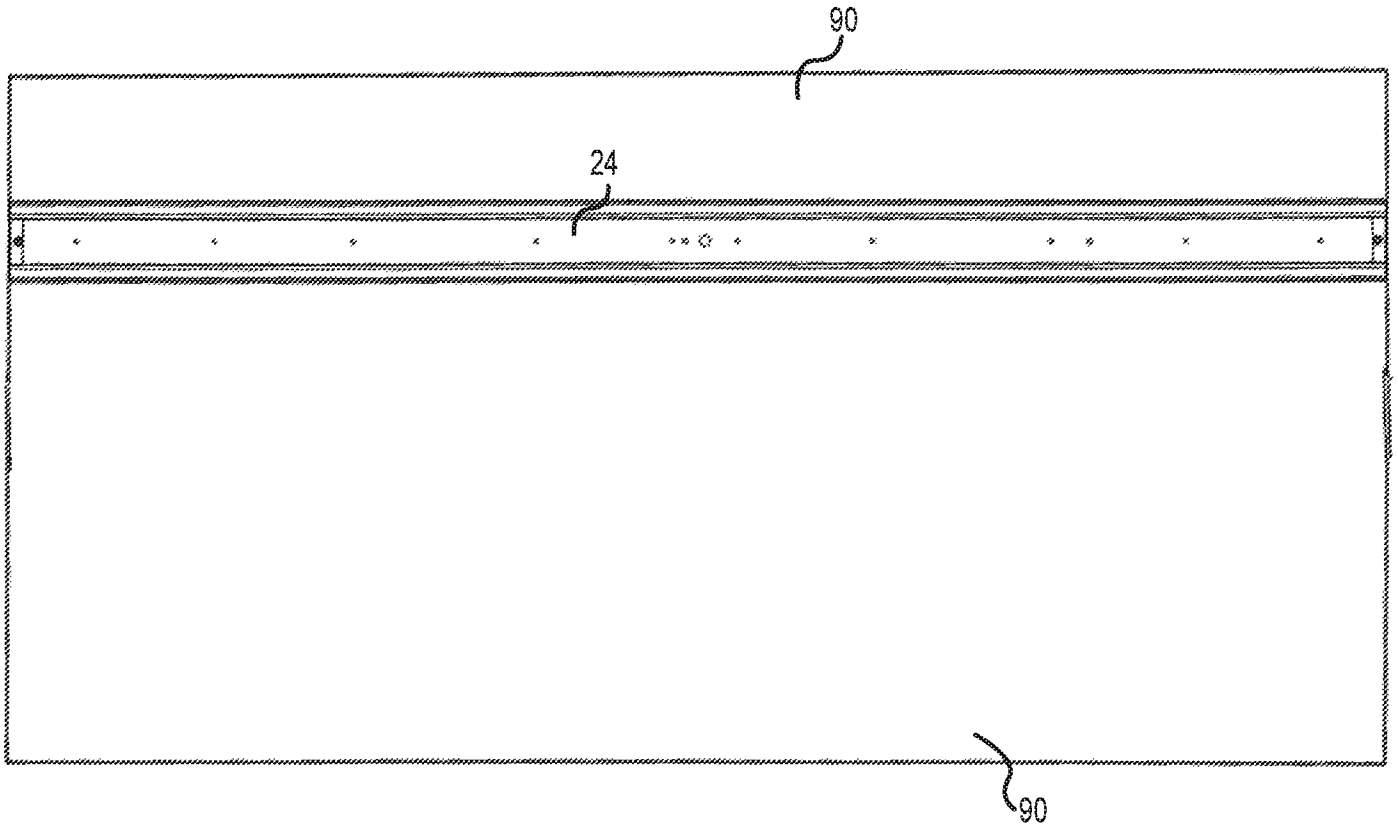
FIG. 10 is a top plan view of a second arrangement of the first embodiment light fixture with attached panels according to the present invention.
Figure 11:
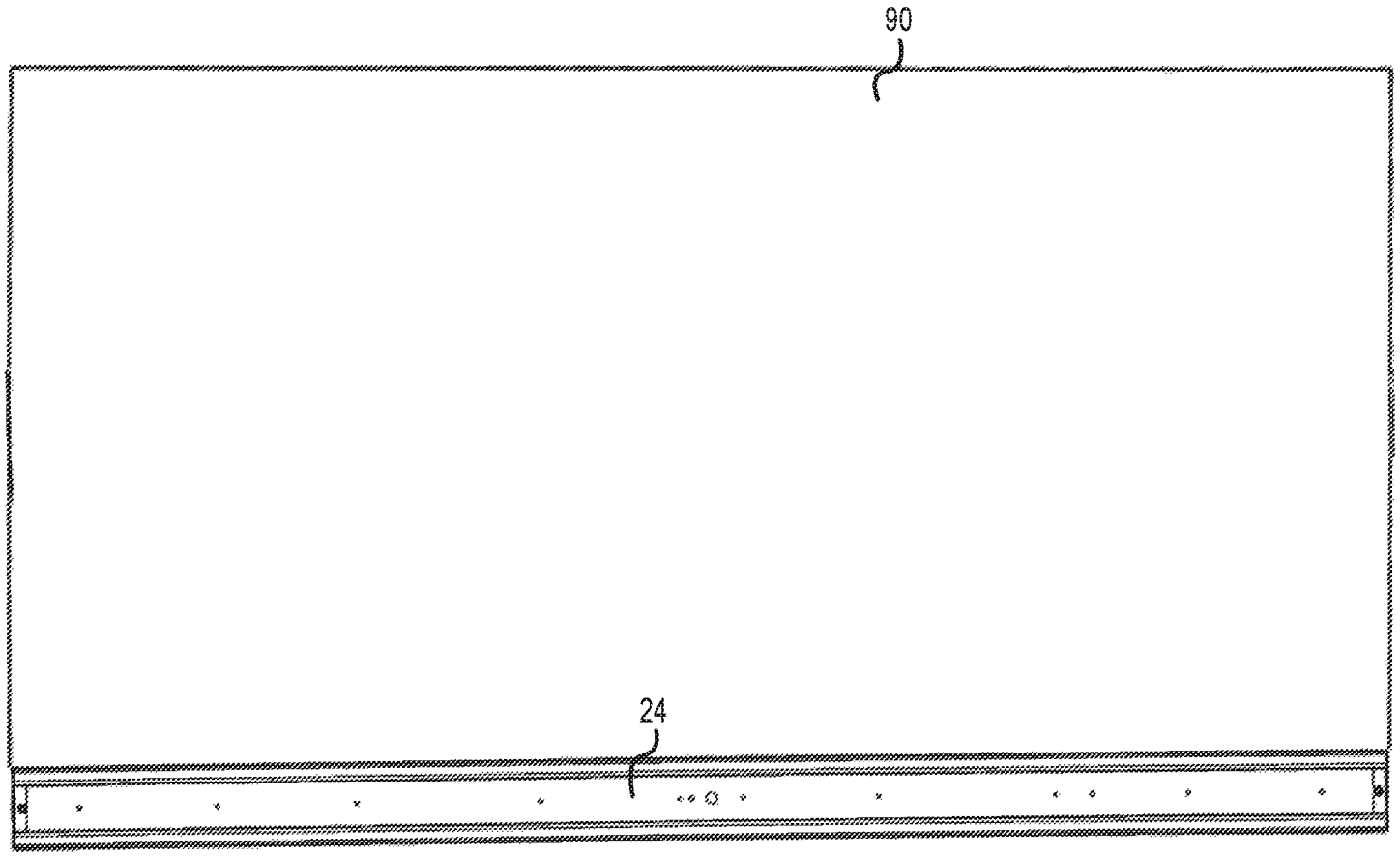
FIG. 11 is a top plan view of a third arrangement of the first embodiment light fixture with an attached panel according to the present invention.
Figure 12:
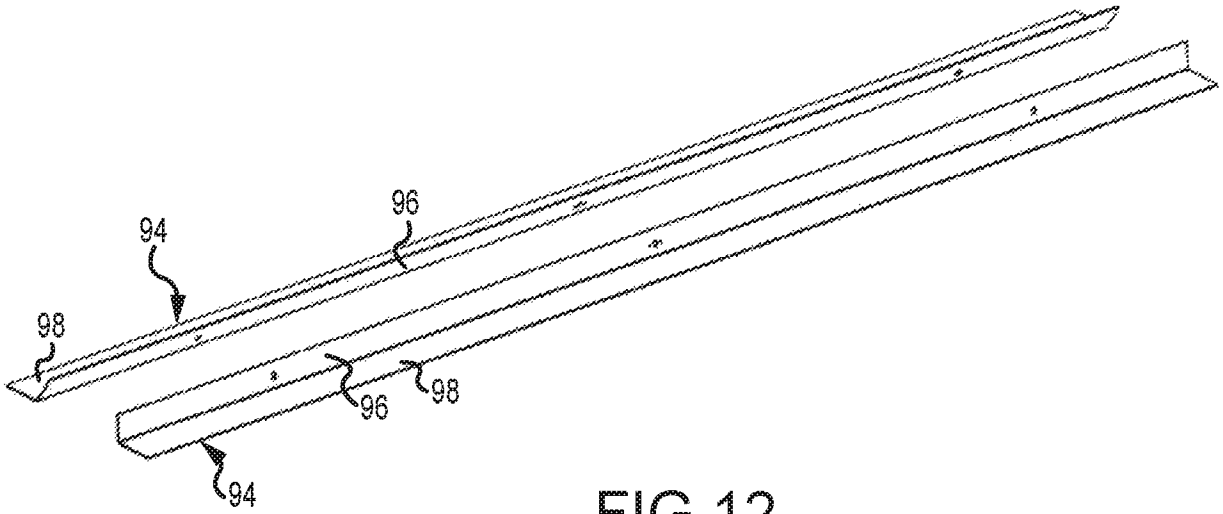
FIG. 12 is a perspective view of a pair of brackets according to the present invention.

The lighting fixture 20 may be mounted within the opening 104 such that lighting fixture 20 is centered along the width of the opening 104 as shown in FIG. 9, or offset to one side along the width of the opening 104 (offset from a centerline of the opening 104) as shown in the examples of FIGS. 10 and 11. At least one filler panel 90 may be mounted between the heat sink 24 and the support members 102 to fill any gap(s) between the heat sink 24 and the support member(s) 102. The filler panels 90 may be formed of conventional acoustical tiles, metal tiles, plastic tiles, etc. The filler panels 90 may have a variety of finishes (e.g., optical or matte finishes), various colors, and/or various surface textures (e.g., smooth, rough).

The filler panels 90 may be attached to the outer surfaces 80*a*, 84*a* of the side walls 80, 84 by any suitable means, such as fasteners or adhesive. Additionally, or alternatively, the filler panels 90 may have an upstanding flange 92 that conforms to the shape of the side walls 80, 84 or a bracket 94 may be provided which has a first leg 96 that conforms to the shape of the side walls 80, 84 and is attached to the side walls 80, 84 by suitable means, such as fasteners or adhesive, and a second leg 98 that is attached to the filler panel 90, whereby the second leg 98 may be attached to the upper surface or the lower surface of the filler panels 90.

The heat sink 24 may be mounted such that the outer surfaces 82*a*, 86*a* of the flanges 82, 86 are flush or substantially flush with the bottom surface(s) 90*a* of the filler panel(s) to provide a mostly uninterrupted ceiling appearance and to provide a pleasing aesthetic appearance (see FIG. 6).

The lighting fixture 20 can be retrofitted into the ceiling 100. To do so, an existing lighting fixture is removed, and the lighting fixture 20 installed, along with the filler panel(s) 90.

Figure 13:
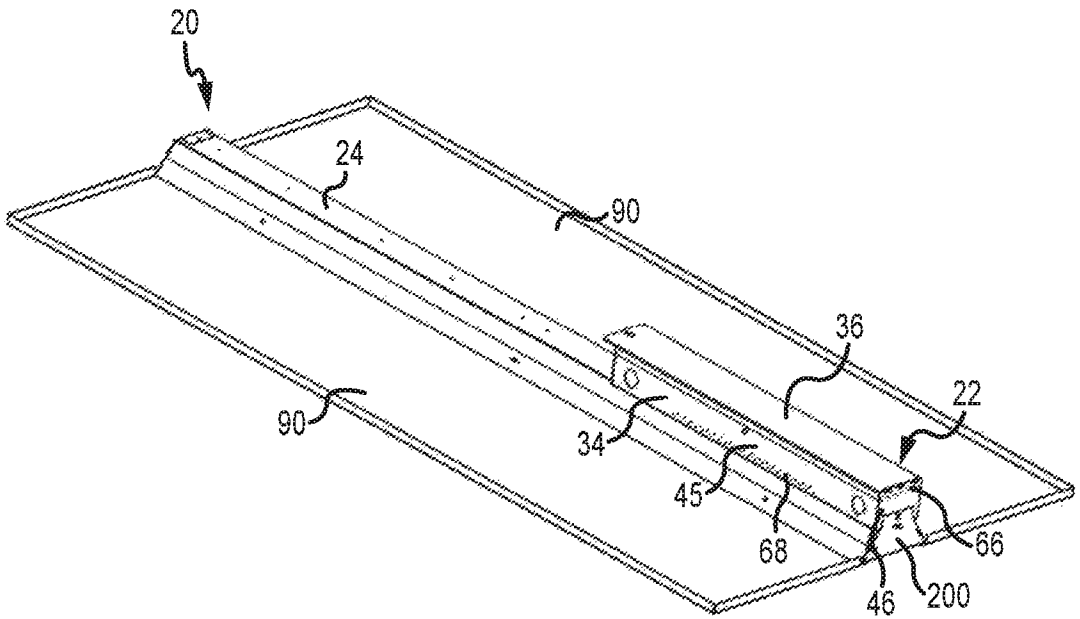
FIG. 13 is a fourth arrangement of the first embodiment light fixture with attached panels according to the present invention.

The driver housing assembly 22 may have a plurality of spaced apart vias 66, 68 (see FIG. 13) extending through at least one of the upstanding walls 44, 45, 46, 47 to provide ventilation for the cavity 40. As shown, the plurality of spaced apart vias 66, 68 are provided in two rows, with the vias 66, 68 being staggered from each other on adjacent upstanding walls (45, 46 as shown in FIG. 13). The vias 66 may be provided through the walls 44, 46 and may be proximate to a top end of each wall 44, 46. The vias 68 may be provided through the walls 45, 47 and may be proximate to a bottom end of each wall 45, 47. The vias 66, 68 allow for the passage of air from an interior of the driver housing assembly 22 to an exterior of the driver housing assembly 22. The vias 66, 68 may have a diameter of approximately 0.068". The vias 66, 68 are preferably this small to reduce the intrusion of dust and other contaminants into the housing 34, while allowing for heated air to flow out of the housing 34. The passage of air allows for convective heat transfer.

Figure 14:
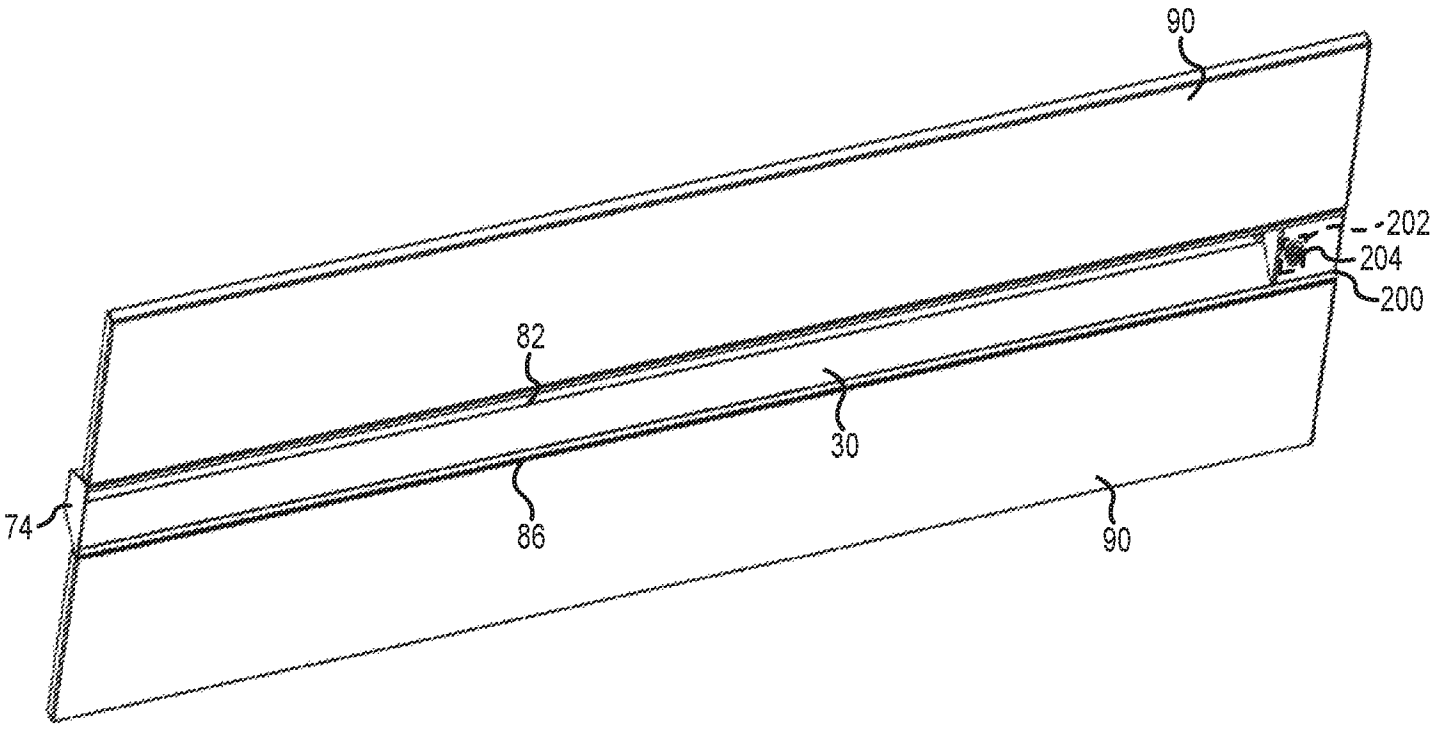
FIG. 14 is a perspective view of a fifth arrangement of the first embodiment of the light fixture according to the present invention with a potentiometer.
Figure 15:
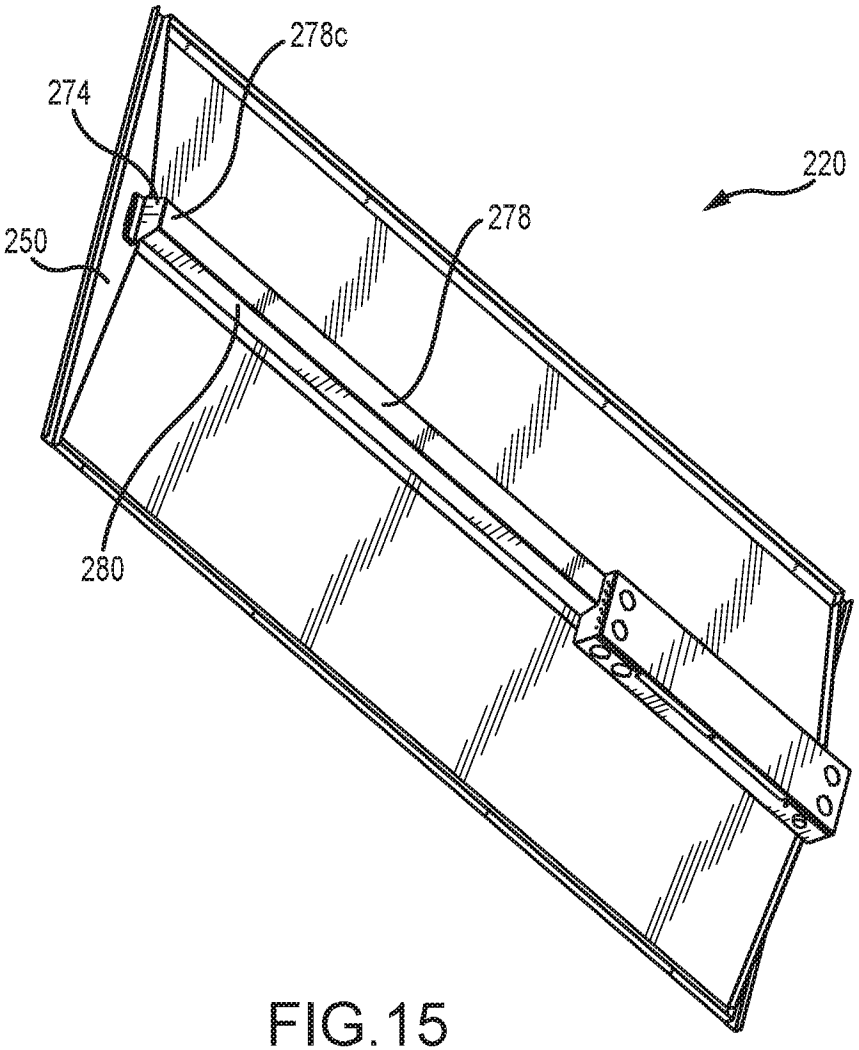
FIG. 15 is a perspective view of a second embodiment of a light fixture according to the present invention.
Figure 16:
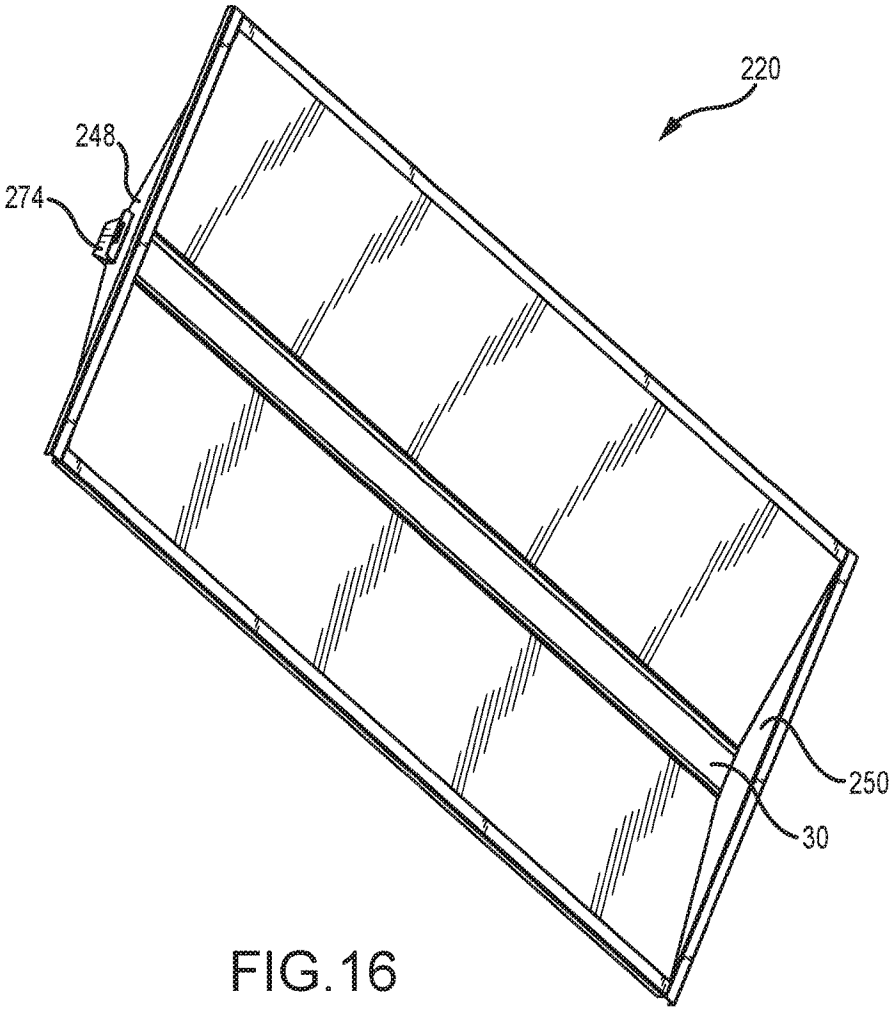
FIG. 16 is a perspective view of the second embodiment of a light fixture shown in FIG. 15 according to the present invention.
Figure 17:
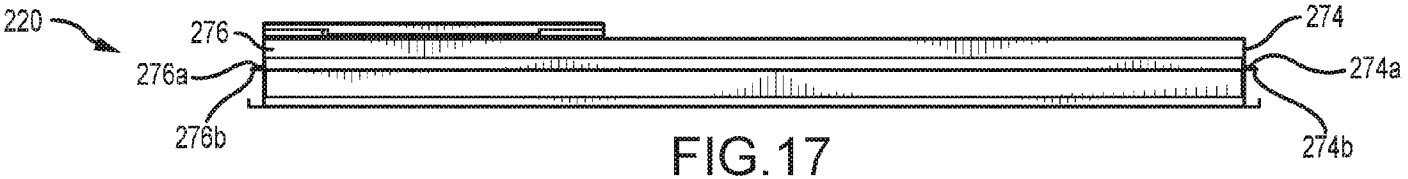
FIG. 17 is a left side elevation view of the second embodiment light fixture shown in FIG. 15 according to the present invention.
Figure 18:
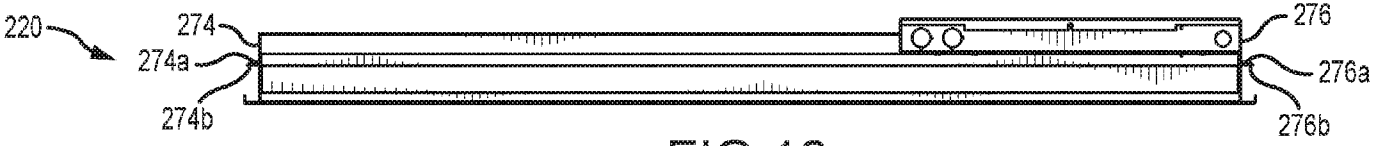
FIG. 18 is a right side elevation view of the second embodiment light fixture shown in FIG. 15 according to the present invention.
Figure 19:
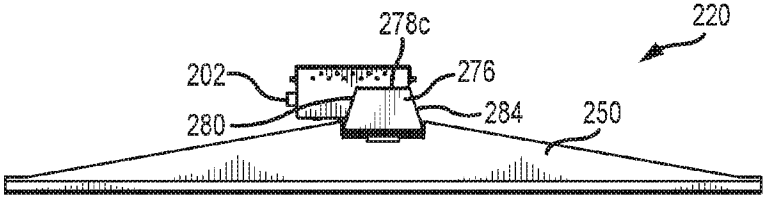
FIG. 19 is a rear elevation view of the second embodiment light fixture shown in FIG. 15 according to the present invention.
Figure 20:
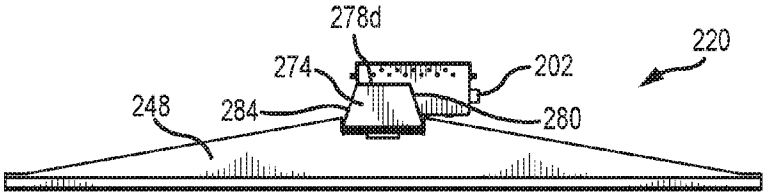
FIG. 20 is a front side elevation view of the second embodiment light fixture shown in FIG. 15 according to the present invention.
Figure 21:
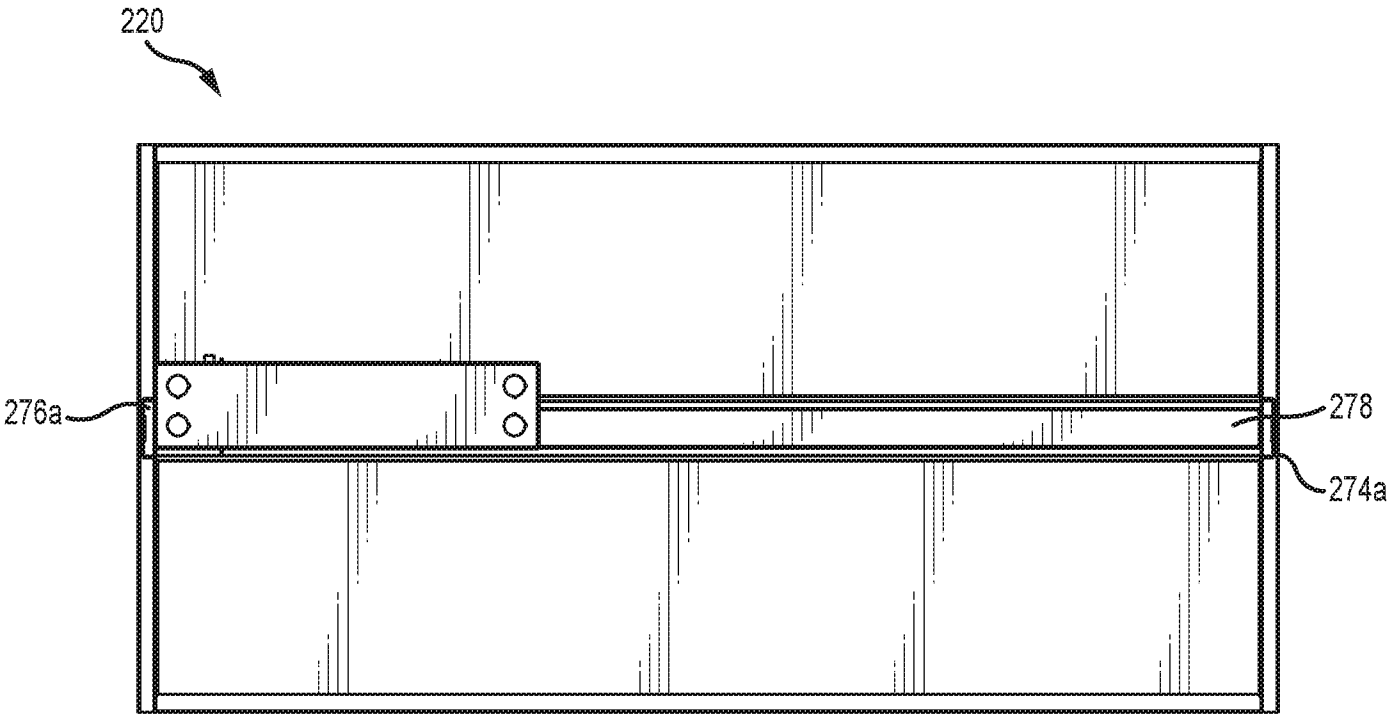
FIG. 21 is a top plan view of the second embodiment light fixture shown in FIG. 15 according to the present invention.
Figure 22:
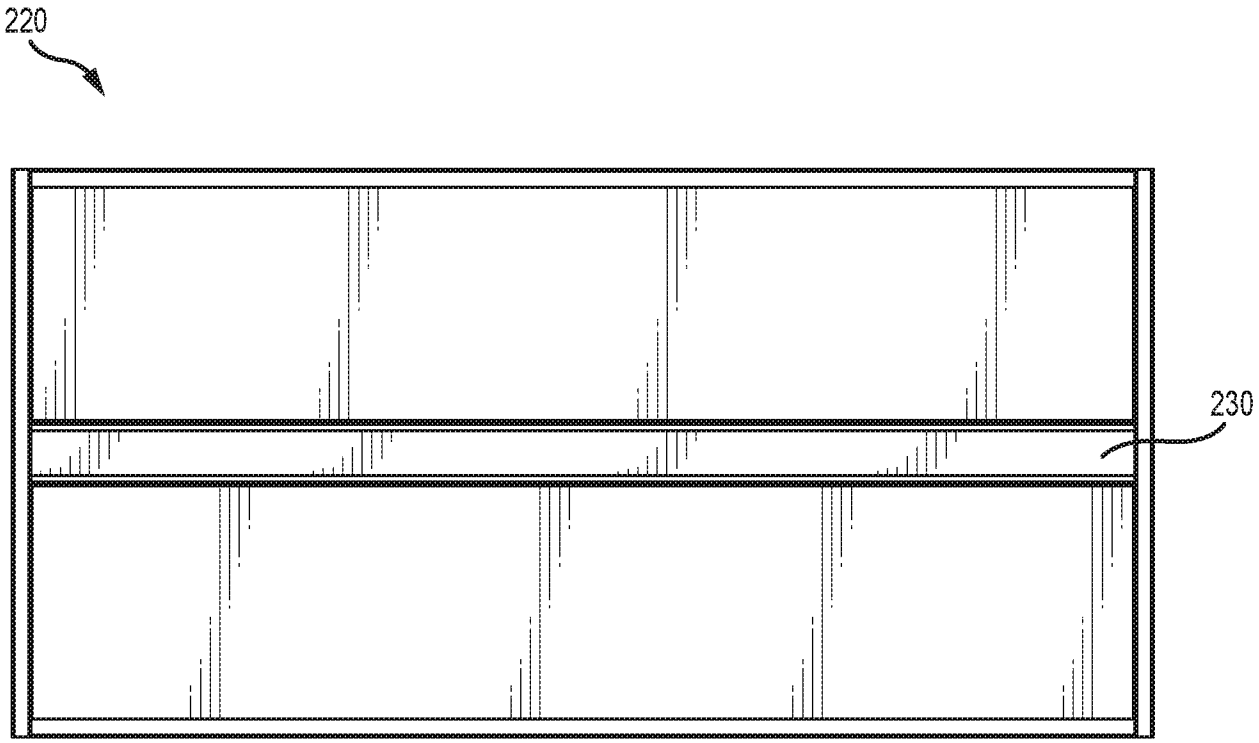
FIG. 22 is a bottom plan view of the second embodiment light fixture shown in FIG. 15 according to the present invention.
Figure 23:
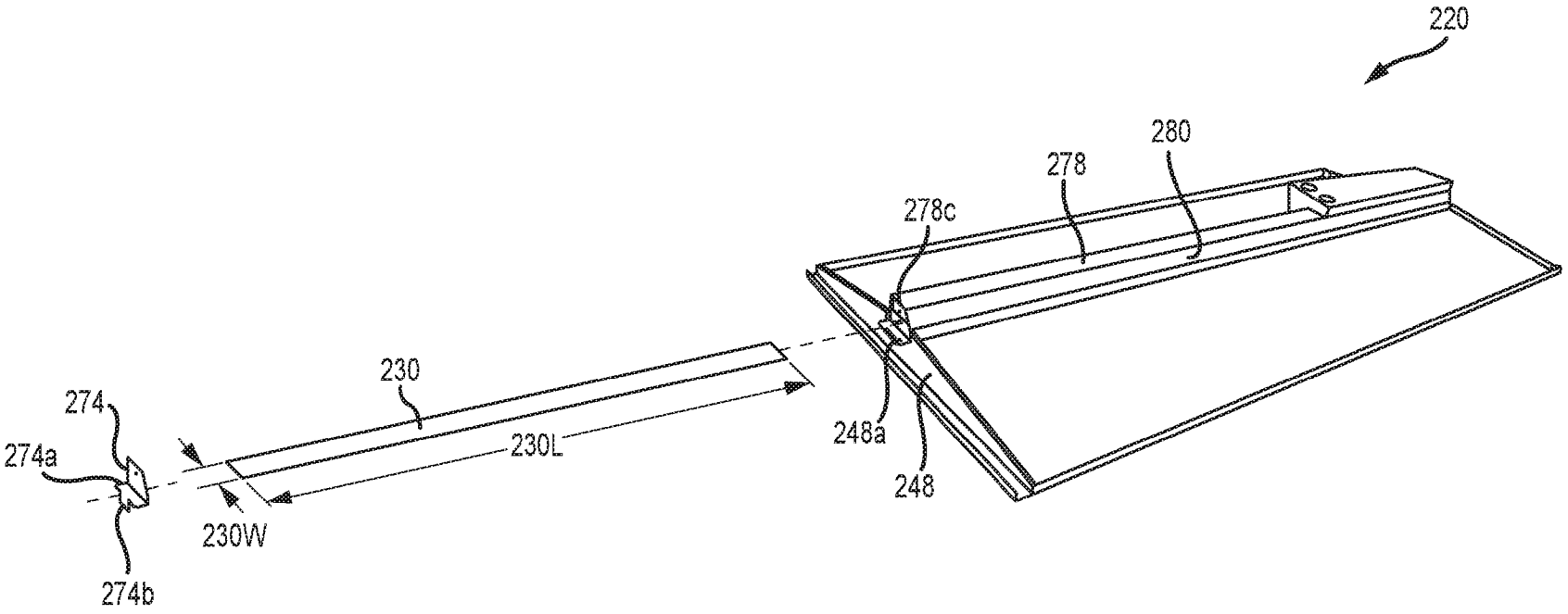
FIG. 23 is a partially exploded view of a second arrangement of the second embodiment light fixture according to the present invention.

Looking to FIGS. 13 and 14, a potentiometer 202 may be included in the fixture 20 and electrically connected to the driver 32 to adjust the level of light output from the LEDs 28 (hidden). In FIG. 13, a bracket 200 is substituted for one of the first and second end caps 74, 76 and configured for mounting the potentiometer 202 onto the lighting fixture 20. The potentiometer 202 is preferably adjusted by turning a knob 204 provided on the lighting fixture 20. The potentiometer 202 may be provided in the bracket 200 as shown or it may be provided elsewhere on the heat sink 24 or housing 34.

Figure 24:
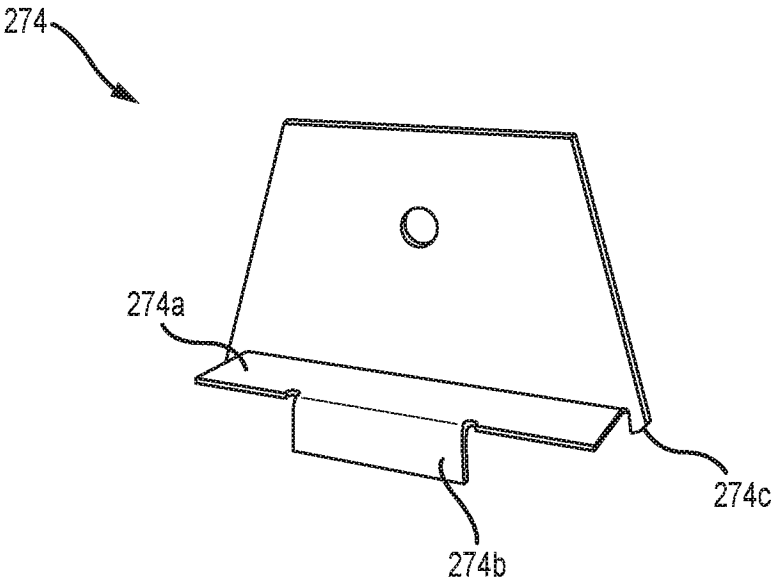
FIG. 24 is a perspective view of a first embodiment of an end cap according to the present invention.
Figure 25:
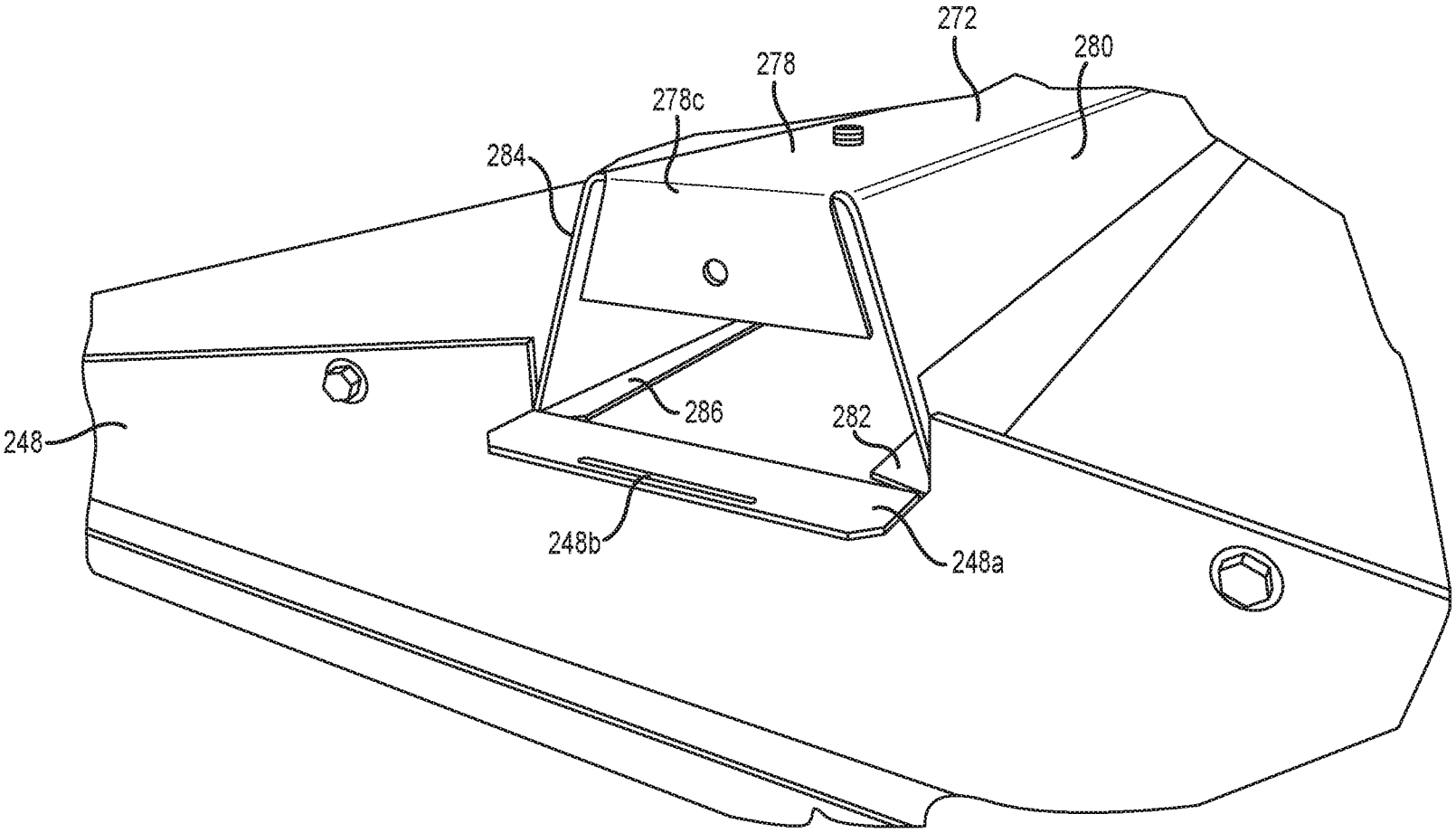
FIG. 25 is partial perspective view of the second embodiment light fixture according to the present invention.

As shown in FIGS. 15-27, a second embodiment 220 of the fixture is shown configured to accommodate expansion of the lens 30 due to heat created by the driver 32 or other heat sources. The fixture 220 has a first end cap 274 and a second end cap 276 configured to attach to the first end 278*c* and the second end 278*d* of the horizontal base wall 278 and/or the first and second sidewalls 280, 284, respectively. The first and second end caps 274, 276 each preferably have an offset portion 274*a*, 276*a* with a tab 274*b*, 276*b* configured to be receivable within a slot 248*b*, 250*b* in shelf portions 248*a*, 250*a* of respective first and second frame members 248, 250 of the fixture 220 (see FIGS. 24 and 25).

The shelf portions 248*a*, 250*a*, according to the embodiment 220 shown, extend outwardly from the U-shaped channel 272 and substantially co-planarly with the first and second flanges 282, 286. The distance between the first and second end caps 274, 276 measured from the tabs 274*b*, 276*b* defines a total shelf length 270.

The first and second end caps 274, 276 preferably have a pair of feet 274*c*, 276*c* which abut the shelf portions 248*a*, 250*a* when the first and second end caps 274, 276 are installed. The feet 274*c*, 276*c* are sized and configured to maintain a predetermined distance 288 between the offset portions 274*a*, 276*a* from the shelf portions 248*a*, 250*a*. The predetermined distance 288 is preferably greater than the thickness 230T of the lens 230.

The lens 230 is preferably configured to have a length 230L which is greater than the heat sink length 224L and less than the total shelf length 270 when resting (i.e., the lighting sources are turned off or otherwise not emitting light) subject to an ambient temperature of about 27° C. More preferably, the length 230L of the lens 230 is greater than:

$$\text{heat sink length } 224L + \frac{\text{total shelf length } 270 - \text{heat sink length } 224L}{2}$$

and less than the total shelf length 270. The lens 230 is preferably configured to experience a heat expansion of less than or equal to about 0.4% of the length 230L when subject to the heat created by the light fixture 220 during use (i.e., the lighting sources are turned on or otherwise emitting light).

Figure 26:
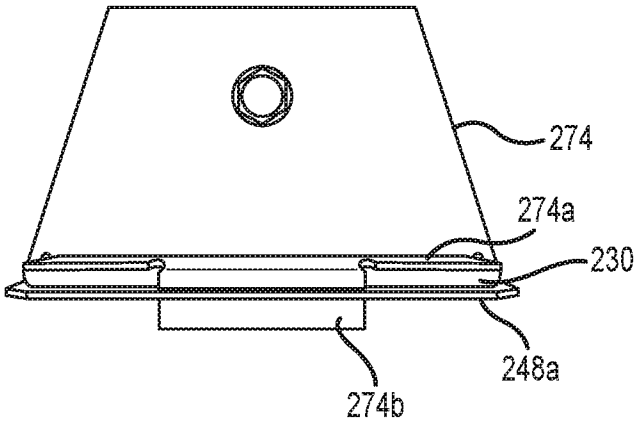
FIG. 26 is a partial front elevation view of the second embodiment light fixture according to the present invention.
Figure 27:
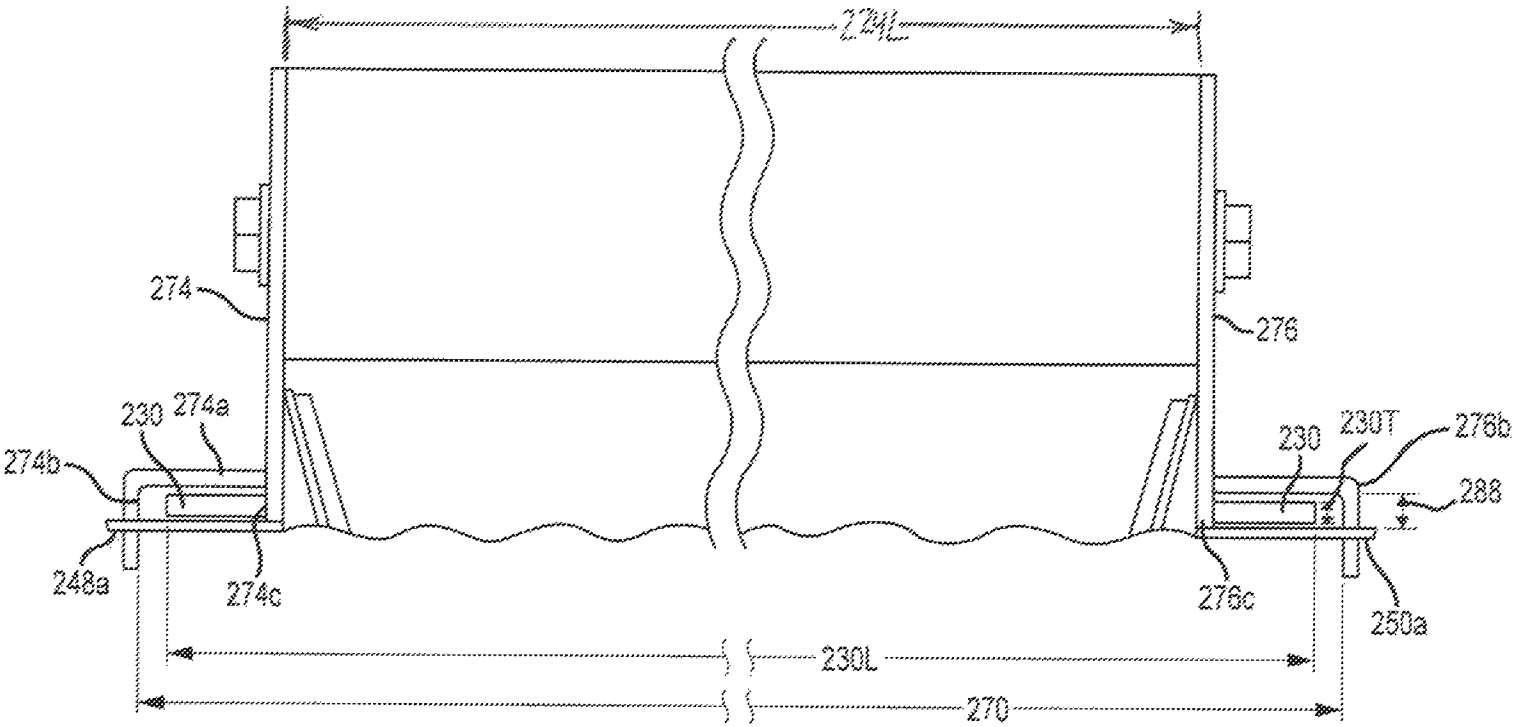
FIG. 27 is a break-line side elevation view of the second embodiment according to the present invention.

A third embodiment 320 of the lighting fixture according to the present invention is shown in FIGS. 26 and 27 and is contemplated to provide a first frame member 348 with a first shelf portion 348*a* and a second frame member 350 with a second shelf portion 350*a* extending into the U-shaped channel 372 and between the first and second flanges 382, 386. A first end cap 374 and a second end cap 376 are shown configured to close off the three-sided open-ended recesses 387, whereby a total opening length 370 is defined as the distance between the first and second shelf portions 348*a*, 350*a*.

The lens 330 is preferably configured to have a length 330L which is greater than the total opening length 370 and less than the heat sink length 324L when subject to an ambient temperature of about 27° C. More preferably, the length 330L of the lens 330 is greater than:

$$\text{heat sink length } 324L - \frac{\text{heat sink length } 324L - \text{total opening length } 370}{2}$$

and less than the heat sink length 324L when subject to an ambient temperature of about 27° C. The lens 330 is preferably configured to experience a heat expansion of less than or equal to about 0.4% of the length 330L when subject to the heat created by the light fixture 320 during use.

Figure 28:
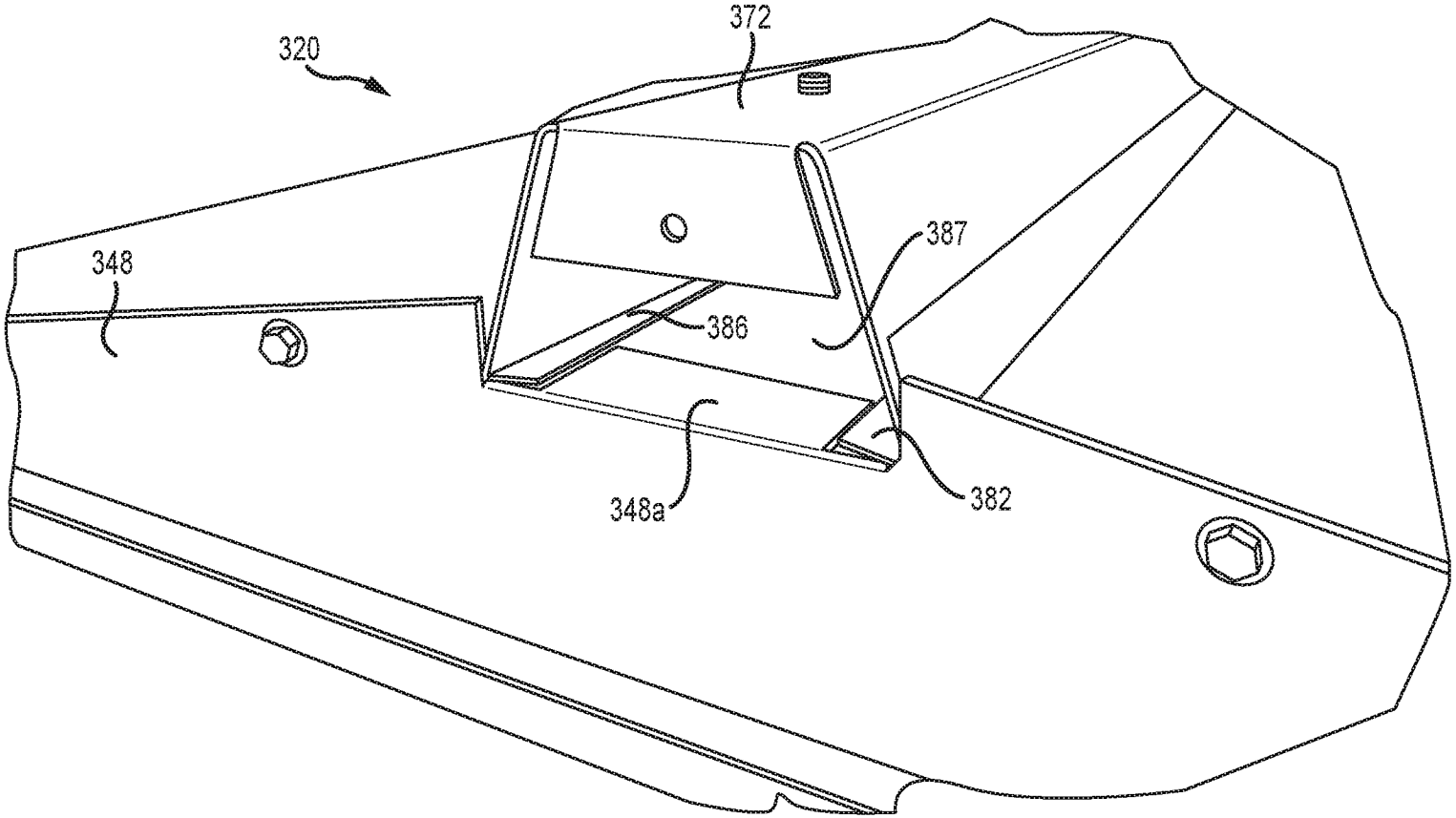
FIG. 28 is a partial perspective view of a third embodiment of a light fixture according to the present invention.
Figure 29:
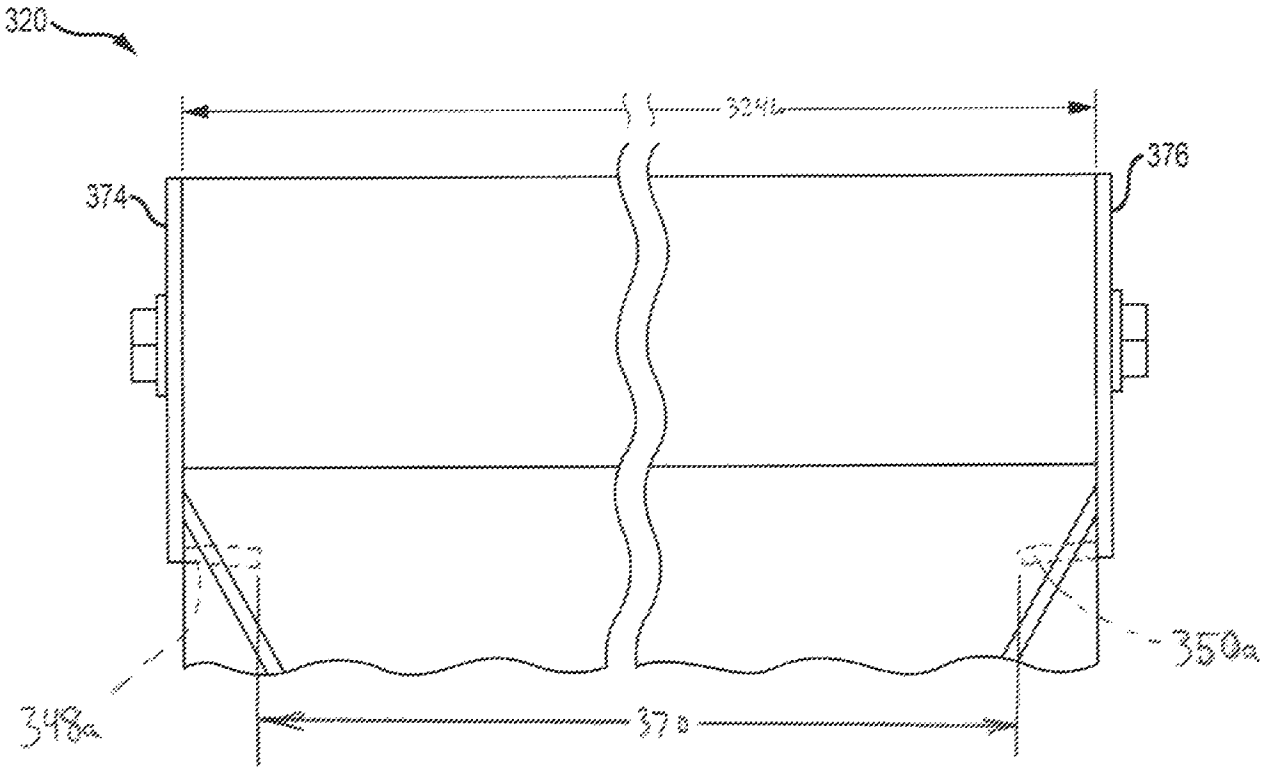
FIG. 29 is a break-line side elevation view of the third embodiment light fixture according to the present invention.
Figure 30:
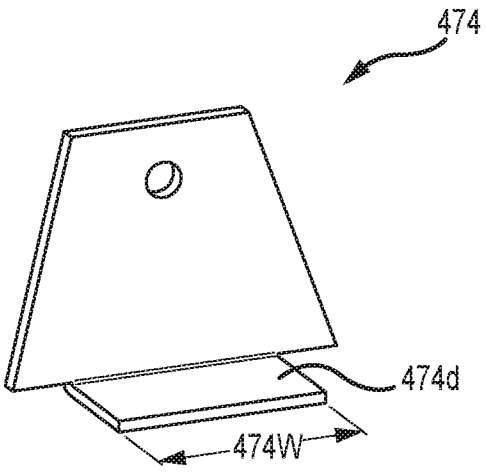
FIG. 30 is a perspective view of a third embodiment of an end cap according to the present invention.

A third embodiment end cap 474 is shown in FIG. 28. The end cap 474 comprises a shelf portion 474*d* with a width 474W configured to extend within the U-shaped channel 72 of the heat sink 24, substantially co-planar with and between the first and second flanges 82, 86 (shown in FIGS. 4 and 6).

While preferred measurements have been specified relative to a heat sink length (e.g., 224L), a lens opening length (e.g., 370), and/or a length of a space in which the lens is disposed (e.g., 270), it is to be generally understood that the lens length 230L is most preferably longer than a length of the opening that it covers and shorter than the distance between supporting structure adapted to interrupt longitudinal displacement of the lens. A lens length longer than the lens opening is helpful for maintaining a clean lens by impeding dust and pest infiltration. A lens length shorter than the structural support length (e.g., shelf length 270) helps to minimize buckling of lens material, such as may be caused by expansion of the material during operation of the lighting fixture.

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

We claim:

1. A light fixture comprising:

a heat sink having a heat sink length, a base wall extending along the heat sink length having a first side edge, a second side edge opposite the first side edge, a first end, a second end opposite the first end, an inside surface, and an outside surface, a first depending side wall extending from the first side edge of the base wall along the heat sink length, and a second depending side wall extending from the second side edge of the base wall along the heat sink length;

each of the first and second depending sidewalls having a lower end portion extending inward toward each other along the heat sink length;

a driver housing assembly affixed to the outside surface of the heat sink, the driver housing assembly comprising a driver, a housing, and a cover, wherein the driver is housed within a cavity defined by the housing and the cover;

at least one light emitting diode (LED) affixed to the inside surface of the heat sink and in electrical communication with the driver;

a substantially planar lens received within the heat sink along the lower end portions of the first and second depending side walls and extending over the at least one LED;

a first end cap attached to the heat sink at the first end;

a second end cap attached to the heat sink at the second end, and at least one panel affixed to and extending from at least one of the first and second depending side walls.

2. The light fixture of claim 1 whereby the light fixture is configured to be installed within a two foot by two foot tray ceiling opening.

3. The light fixture of claim 1 whereby the light fixture is configured to be installed within a two foot by four foot tray ceiling opening.

4. The light fixture of claim 1 further comprising a first frame member affixed to the at least one panel at the first end of the heat sink and a second frame member affixed to the at least one panel at the second end of the heat sink, and whereby the at least one panel angles downward from the heat sink at an angle greater than zero degrees relative to the lens.

5. The light fixture of claim 4, wherein the first frame member has a shelf portion with a slot, the shelf portion extending outwardly away from the heat sink and substantially coplanar with the lower end portions of the first and second depending side walls;

the second frame member has a shelf portion with a slot, the shelf portion extending outwardly away from the heat sink and substantially coplanar with the lower end portions of the first and second depending side walls;

the first end cap has an offset portion with a tab extending therefrom configured to be receivable within the slot of the shelf portion of the first frame member;

the second end cap has an offset portion with a tab extending therefrom configured to be receivable within the slot of the shelf portion of the second frame member;

wherein the distance between the tabs of the first and second end caps defines a total shelf length; and whereby the lens has a length less than the total shelf length.

6. The light fixture of claim 5, wherein the substantially planar lens has a thickness;

the first end cap has a pair of feet configured to contact the shelf portion of the first frame member and define a first distance between the offset portion of the first end cap and the shelf portion of the first frame member;

the second end cap has a pair of feet configured to contact the shelf portion of the second frame member and define a second distance between the offset portion of the second end cap and the shelf portion of the second frame member; and whereby the thickness of the lens is less than the first distance and less than the second distance.

7. The light fixture of claim 6, wherein the lens length is greater than or equal to $$\text{the heat sink length} + \frac{\text{total shelf length} - \text{heat sink length}}{2}$$

and less than the total shelf length when exposed to an ambient temperature of 27° C.

8. The light fixture of claim 7, wherein the substantially planar lens is configured to experience a heat expansion of less than or equal to 0.004% the lens length when exposed to heat generated by the light fixture during use.

9. The light fixture of claim 4, wherein the first frame member has a shelf portion, the shelf portion extending inwardly into the heat sink and substantially coplanar with the lower end portions of the first and second depending side walls;

the second frame member has a shelf portion, the shelf portion extending inwardly into the heat sink and substantially coplanar with the lower end portions of the first and second depending side walls; and whereby the substantially planar lens has a length greater than the total opening length and less than the heat sink length.

10. The light fixture of claim 9, wherein the length of the substantially planar lens is greater than or equal to $$\text{heat sink length } 324L - \frac{\text{heat sink length } 324L - \text{total opening length } 370}{2}$$

and less than the heat sink length when exposed to an ambient temperature of 27° C.

11. The light fixture of claim 10, wherein the substantially planar lens is configured to experience a heat expansion of less than or equal to 0.004% the length of the lens when exposed to heat generated by the light fixture during use.

* * * * *